United States Patent [19]

White

[11] Patent Number: 5,040,346

[45] Date of Patent: Aug. 20, 1991

[54] DUST GAP SPACER FOR WALL TO WALL CARPETING

[76] Inventor: Laurence E. White, 2601 E. Victoria, No. 476, Compton, Calif. 90220

[21] Appl. No.: 505,364

[22] Filed: Apr. 5, 1990

[51] Int. Cl.[5] ..... E04B 5/00

[52] U.S. Cl. ..... 52/287; 52/102; 52/273; 47/33

[58] Field of Search ..... 52/287, 288, 273, 102; 47/33

[56] References Cited

U.S. PATENT DOCUMENTS

| | | | |
|---|---|---|---|
| 1,559,747 | 11/1925 | Hall | 52/273 |
| 2,230,688 | 2/1941 | Irwin | 52/288 X |
| 2,441,391 | 5/1948 | Bragiel et al. | 52/288 X |
| 3,086,262 | 4/1963 | Krantz | 52/287 X |
| 3,549,471 | 12/1970 | Denton | 52/288 X |
| 3,638,314 | 2/1972 | Harby | 52/288 X |
| 3,815,306 | 6/1974 | Tantlinger | 52/288 X |
| 3,974,609 | 8/1976 | Attaway | 52/273 |

*Primary Examiner*—David A. Scherbel
*Assistant Examiner*—Linda J. Watson
*Attorney, Agent, or Firm*—Charles H. Thomas

[57] ABSTRACT

A dust gap spacer is provided for use along a baseboard at the foot of a wall where the wall intersects a floor. The spacer is installed prior to the installation of wall to wall carpeting. The dust gap spacer is of a uniform L-shaped cross section throughout and is formed with a raised shoulder adapted to reside at the foot of a wall and a ledge in contact with the floor and extending away from the wall and from the shoulder at a height lower than the shoulder. A tack strip is located atop the ledge and the peripheral margin of the carpeting resides atop the tack strip and in abutment against the shoulder. The dust gap spacer permits an upright vacuum cleaner to clean the entire carpeting, including the peripheral margin thereof, and provides a decorative trim strip surrounding the carpeting at the base of the wall. The dust gap spacer eliminates an unsightly dirty marginal border around the carpeting.

3 Claims, 1 Drawing Sheet

DUST GAP SPACER FOR WALL TO WALL CARPETING

BACKGROUND OF THE INVENTION

1. Field cf the Invention

The present invention relates to a dust gap spacer for use about the perimeter of wall to wall carpeting to enable the peripheral edge of the carpet to be cleaned with an upright vacuum cleaner.

2. Description of the Prior Art

At present, wall to wall carpeting is widely used as the floor covering of choice throughout many commercial establishments and residences. Wall to wall carpeting is durable and conceals dirt and lint better than other floor surfaces. Wall to wall carpeting can be cleaned quickly and easily simply by vacuuming it with a standard, commercially available upright vacuum cleaner, as contrasted with hard floor surfaces which require mopping, buffing and scrubbing as a means for cleaning.

One significant disadvantage which has existed with wall to wall carpeting is the fact that the physical construction of conventional upright vacuum cleaners is such that the extreme peripheral margin of wall to wall carpeting cannot be vacuumed. This inaccessibility of the extreme peripheral edge of the carpeting is due to the fact that the mounting of the roller in the vacuum cleaner head that bears a brush and beater bar in a conventional upright vacuum cleaner requires a certain minimum space within the housing for the vacuum cleaner head.

A typical upright vacuum cleaner roller is about an inch and one half in diameter and must be mounted with a certain clearance from the front wall of the housing. As a consequence, when the front or side of the housing is moved into contact with the baseboard at the base of a wall, the beating and brushing effects of the vacuum cleaner terminate about one inch from the junction of the carpeting with the wall or baseboard at the foot of the wall. The marginal border of the carpeting is thereby inaccessible for cleaning and, with time, forms an unsightly margin about the entire expanse of wall to wall carpeting which elsewhere remains in attractive condition. The same peripheral margin of about one inch about the entire perimeter of wall to wall carpeting can never be cleaned and dirt se'tles into this peripheral marginal border area of the carpeting.

While small hand-held vacuuming systems and wand type vacuuming systems can be utilized to clean the marginal border of wall to wall carpeting which is inaccessible using conventional upright vacuum cleaners, the use of such implements over the lengthy periphery of the carpeting is quite arduous and tiresome. To clean the marginal periphery of the carpeting in this manner requires a person to bend over for a considerable period of time. An upright vacuum cleaner is far quicker and easier to use than other conventional vacuuming implements. Furthermore, it is discouraging and demoralizing to have to go over the peripheral margin of wall to wall carpeting after having previous traversed the same area with an upright vacuum cleaner. Consequently, more often than not, the peripheral margin of wall to wall carpeting is left uncleaned and with time becomes unsightly.

SUMMARY OF THE INVENTION

The present invention involves the use of a dust gap spacer that extends along a baseboard or wall at the foot of a wall where it intersects a floor prior to the installation of wall to wall carpeting. In cross section the dust gap spacer is an L-shaped structure which includes a ledge that resides in contact with the floor and extends toward the center of the room and a raised shoulder that resides flush against the vertical baseboard or wall surface. A conventional tack strip of the type normally positioned against the baseboard is located on the ledge and is secured to the floor by nails that extend through the ledge of the dust gap spacer. The carpet pad abuts against the tack strip and the dust gap spacer ledge. The carpeting extends beyond the padding over the tack strip in the usual manner into abutment against the raised shoulder of the dust gap spacer. The width of the raised shoulder is preferably about one inch, so that the extreme edge of the carpeting terminates about one inch from the wall or baseboard against which the shoulder resides.

The purpose of the invention is to allow a conventional upright vacuum cleaner to clean the very extreme periphery of carpeting which is impossible to clean with such a machine in conventional wall to wall carpeting installations. In conventional carpeting installations the vacuum cleaner roller of an upright vacuum cleaner cannot reach the marginal edge of the carpeting which abuts the baseboard. By providing a dust gap spacer even the extreme edge of the carpet can be cleaned, and does not present an unsightly dirty marginal border, as is presently the case.

The dust gap spacer is preferably comprised of injection molded or extruded plastic or any other suitable material such as a vinyl or butyl based product. The dust gap spacer may be formed in any variety of attractive decorator colors. The dust gap spacer strips may be formed of any length, but may be conveniently cut in four foot sections for ease of commercial display, sale and transportation. During installation the dust gap spacer strips may be cut to length as required by the size of the room. Interconnecting sections of the strips may be mitered at corners so that the exposed surfaces of the raised shoulders of the dust gap spacers present a neat, smooth, uninterrupted and finished appearance about the perimeter of the carpeting.

The dust gap spacer of the invention prevents the accumulation of dust and dirt on the peripheral edge of carpeting which an upright vacuum cleaner simply cannot reach. Any dust or lint that may accumulate on the raised shoulder of the dust gap spacer may be easily and rapidly moved toward the center of the carpeting with a feather duster or broom and then vacuumed during normal vacuuming of the wall to wall carpeting with a conventional upright vacuum cleaner.

In one broad aspect the present invention is a dust gap spacer adapted for use at the junction of a wall and a floor to be covered with wall to wall carpeting. The dust gap spacer is comprised of an elongated strip of uniform cross section throughout formed with a raised shoulder adapted to reside at the base of the wall and a ledge extending away from the wall and from the shoulder at a height lower than that of the shoulder. The shoulder and the ledge are preferably each about one inch in width, and the shoulder is about one inch in height above the floor. The projecting ledge rests in contact with the floor and is preferably about one eighth of an inch in height above the floor so that when a conventional tack strip is placed atop the ledge, the total thickness of the tack strip and the ledge is approximately equal to the thickness of the padding beneath the wall to wall carpeting.

The padding terminates at the interiorally directed edge of the ledge while the carpeting extends the one inch distance beyond the termination of the padding, over the tack strip and into abutment against the shoulder of the dust gap spacer. The height of the shoulder is preferably about the same vertical level as the height of the carpeting, so as to avoid stubbing one's toe on the raised shoulder. The raised shoulder should not project any significant distance above the pile of the carpeting, as it is necessary for the front of the upright vacuum cleaner head housing to pass over the shoulder all the way to the vertical wall or baseboard.

In another broad aspect the invention may be considered to be a dust gap spacer adapted for use with wall to wall carpeting and comprising an elongated strip of uniform cross section throughout. The strip has a flat base surface, a raised shoulder located at an elevation above the base surface and extending parallel thereto, and a ledge located above the flat base surface and laterally adjacent to and below the level of the shoulder. The elevation of the shoulder is about one inch above the base surface and the elevation of the ledge is about one eighth of an inch above the flat base surface. The ledge and the shoulder are each about one inch in width.

In yet another aspect the invention may be considered to be the combination of a dust gap spacer of uniform cross section throughout adapted for placement on a floor at a junction between the floor and a wall. The dust gap spacer is formed with a raised shoulder located adjacent the wall and a shelf having a height less than that of the shoulder and extending laterally therefrom. A tack strip is located atop the shelf and carpeting is disposed on the floor and has a peripheral margin that resides atop the tack strip and in abutment against the shoulder. Normally, carpet padding is located atop the floor and in abutment against the interior edge of the shelf. The peripheral margin of the carpeting extends out over the carpet padding and atop the tack strip. The carpeting pile extends upwardly to the level of the shoulder.

The invention may be described with greater clarity and particularity with reference to the accompanying drawings.

DESCRIPTION OF THE EMBODIMENT

Figure 1:
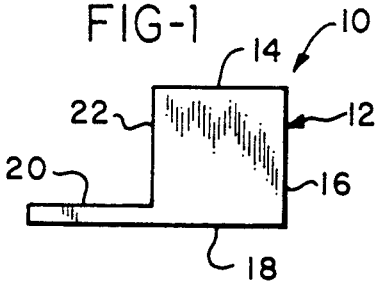
FIG. 1 is an end view of a dust gap spacer strip in accordance with the invention.
Figure 2:
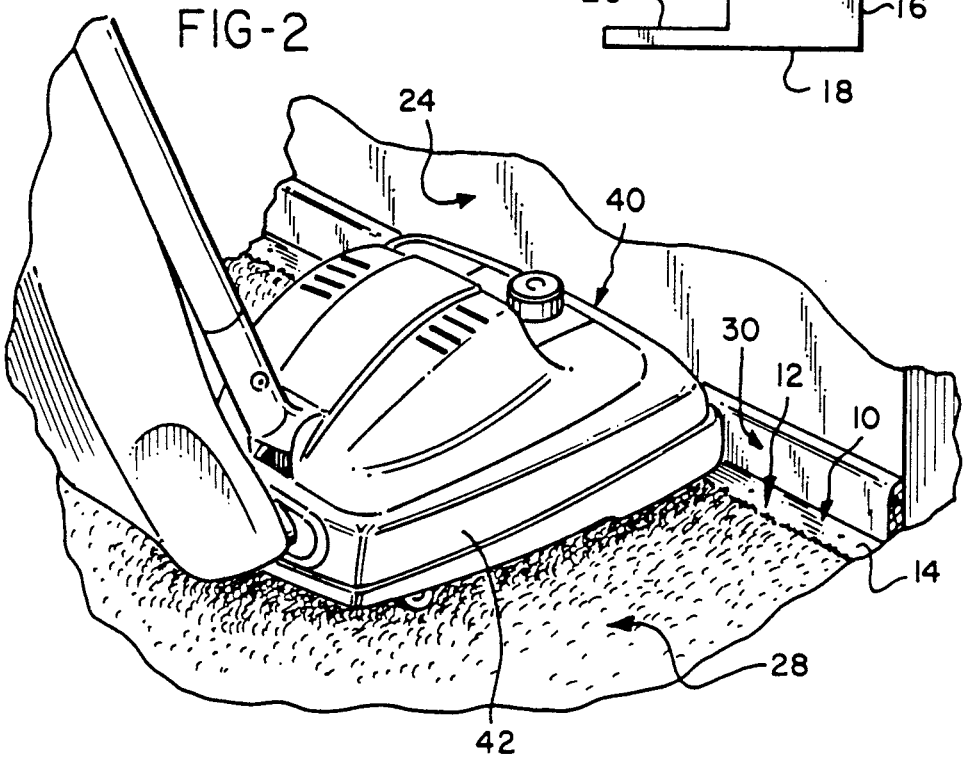
FIG. 2 is a perspective view illustrating the use of the dust gap strip of the invention.
Figure 3:
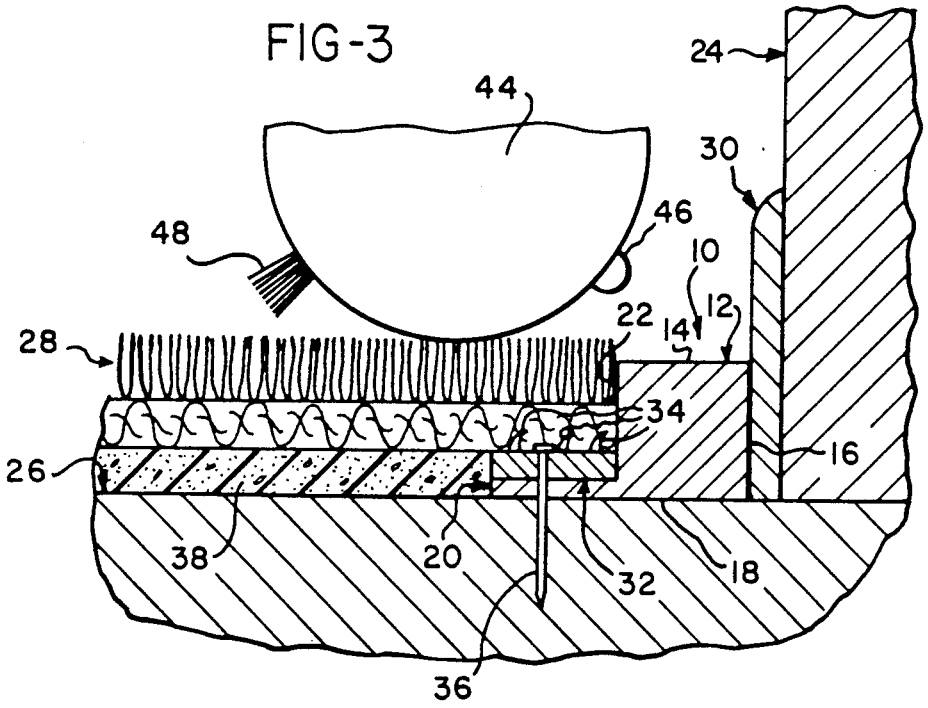
FIG. 3 is a side elevational sectional view illustrating the dust gap spacer of the invention in combination with a tack strip and wall to wall carpeting.

A dust gap spacer 10 is provided for use with wall to wall carpeting 28 as illustrated in FIGS. 2 and 3. The dust gap spacer 10 is formed as an extruded or injection molded plastic strip of uniform L-shaped cross section throughout. FIG. 1 illustrates the cross section of the dust gap spacer 10 in an end view. The dust gap spacer 10 is formed with a raised shoulder 12 having a flat, horizontal upper surface 14 about one inch in width and a flat vertical side 16 about one inch in height above a horizontal flat base surface 18. A horizontally disposed ledge or shelf 20 extends laterally outwardly from the interiorally facing vertical side 22 of the shoulder 12 at a height of about one eighth of an inch above the flat base surface 18. The ledge or shelf 20 is about one inch in width and is located laterally adjacent to and below the level of the shoulder 12 above the flat base surface 18. Both the upper surface 14 of the shoulder 12 and the ledge 20 extend parallel to each other and parallel to the flat base surface 18.

The dust gap spacer 10 may be provided in any number of different lengths, but may be conveniently offered for sale in lengths of four feet each. The dust gap spacer 10 is adapted for use at the junction of an interior wall 24 of a residence or commercial building with a floor 26 which is to be covered with the wall to wall carpeting 28. Typically a wooden or plastic baseboard 30 between about two inches and four inches in height is fastened to the foot of the wall 24 where it meets the floor 26.

The dust gap spacer 10 may be conveniently installed together with a wall to wall carpeting tack strip 32, visible in FIG. 3. The tack strip 32 is an elongated, flat wooden strip about one inch in width and about one quarter of an inch in thickness. The tack strip 32 contains a multiplicity of metal barbs 34 along its length projecting upwardly and inclined toward the wall 24. The tack strip 32 and the dust gap spacer 10 are installed together by pressing the upright face 16 of the shoulder 12 of the dust gap spacer 10 against the outwardly facing vertical surface of the baseboard 30 at the wall 24. The tack strip 32 is then positioned atop the ledge 20. Nails 36 are driven through the tack strip 32 and through the ledge 20 into the floor 26 therebeneath at longitudinal intervals of perhaps four or five inches. Both the tack strip 32 and the dust gap spacer 10 are thereby securely fastened to the floor 26 with the outwardly facing vertical surface 16 of the shoulder 12 residing in intimate contact with the inwardly facing surface of the baseboard 30 throughout its entire length. If desired, the baseboard 30 may be omitted entirely and the shoulder 12 can be positioned in direct contact with the wall 24.

Once the tack strip 32 and dust gap spacer 10 have been installed, the wall to wall carpeting 28 is installed in a conventional manner. That is, a jute or polyurethane foam padding 38 is laid across the floor 26 and is cut to fit in abutment against the outwardly facing vertical edges of the tack strip 32 and the ledge 20, as illustrated in FIG. 3. The thickness of the padding 38 should be approximately equal to the combined thickness of the tack strip 32 and the height of the ledge 20 above the flat base surface 18 of the dust gap spacer 10. The wall to wall carpeting 28 is next overlaid atop the padding 38.

As illustrated in FIG. 3 the peripheral margin of the carpeting 38 extends about one inch beyond the termination of the padding 38, so that the carpeting 28 extends all the way to the surface 22 of the shoulder 12. To reach the wall 22 of the shoulder 12 the carpeting 28 is stretched in a conventional manner using a carpet stretcher so that the upwardly projecting barbs 34 from the tack strip 32 stretch the carpet taut and anchor the carpeting 28 about its extreme marginal border throughout its entire perimeter. The height of the pile of the carpeting 28 is preferably at about the same level as the flat, horizontal surface 14 of the shoulder 12.

Once the dust gap spacer 10, the tack strip 32 and the carpeting 28 with padding 38 have been installed in combination as illustrated, the flat, horizontal surface 14 of the shoulder 12 presents and attractive, easily cleanable border extending about the entire perimeter of the wall to wall carpeting 28. As illustrated in FIGS. 2 and 3, a conventional upright vacuum cleaner 40 can be used to clean the entire area of the wall to wall carpeting 28. The upright vacuum cleaner 40 has an enclosing metal or plastic housing 42. A cylindrical roller 44 is mounted at the extreme front of the housing 42. The roller 44 carries a beater bar 46 and a brush 48.

In conventional wall to wall carpeting installations the roller 44 cannot reach the extreme marginal edge of wall to wall carpeting 28 where the carpeting edge meets the vertical surface of the wall 24 or baseboard 30. As a consequence, that extreme marginal peripheral border remains inaccessible for vacuum cleaning with an upright vacuum cleaner 40 throughout the useful life of the carpeting. By employing the dust gap spacer 10 in the manner described, however, the roller 40 can reach the extreme peripheral edge of the carpeting 28 to beat and brush the peripheral carpeting edge so that dirt and dust can be vacuumed therefrom. As a consequence, the carpeting 28 does not present an unsightly soiled marginal border about its perimeter at the wall 24, but may be uniformly cleaned throughout its entire expanse.

The dust gap spacer 10 may be provided in any desired decorator colors. Preferably, the dust gap spacer 10 has a high gloss finish both for aesthetic appearance and also for ease of dusting. To dust the entire length of the upwardly facing shoulders 14 of dust gap spacers 10 secured end to end along the base of a wall 24, a feather duster or broom may merely be moved in a single pass quickly along the entire length of the finishing trim provided by the shoulders 12 of the dust gap spacers 10. This procedure takes only a very few minutes, even in a large room. The carpeting 28 is then vacuumed throughout its entire expanse using a conventional upright vacuum cleaner 40, as illustrated.

Undoubtedly, numerous variations and modifications of the invention will become readily apparent to those familiar with carpeting and interior decorating. Accordingly, the scope of the invention should not be construed as limited to the specific embodiment depicted and described herein, but rather is defined in the claims appended hereto.

I claim:

1. A combination of a dust gap spacer of uniform cross section throughout and adapted for placement on a floor at a junction between said floor and a wall, wherein said dust gap spacer is a unitary linear structure of uniform cross section throughout located adjacent said wall and formed with a flat, horizontal upper surface about one inch in width and an intersecting vertical surface which together define a raised shoulder located inwardly from said wall and a shelf formed at a lower extremity of said vertical surface and having a height less than that of said shoulder and extending laterally therefrom away from said wall, a tack strip located atop said shelf, and carpeting disposed on said floor and having a peripheral margin that resides atop said tack strip and in abutment against said shoulder and said carpeting has a pile that extends upwardly to a level of said horizontal surface at said shoulder.

2. The combination of claim 1 wherein said height of said shoulder is about one inch and said height of said shelf is about one eighth of an inch.

3. The combination according to claim 1 further comprising carpet padding located atop said floor and in abutment against said shelf, and said peripheral margin of said carpeting extends out over said carpet padding and onto said tack strip.

* * * * *